United States Patent [19]

Trulaske

[11] Patent Number: 4,886,266

[45] Date of Patent: Dec. 12, 1989

[54] EXERCISE TREADMILL

[75] Inventor: James A. Trulaske, Maryland Heights, Mo.

[73] Assignee: True Fitness Technology, Inc., O'Fallon, Mo.

[21] Appl. No.: 197,154

[22] Filed: May 23, 1988

[51] Int. Cl.[4] ..... A63B 23/06

[52] U.S. Cl. ..... 272/69; 198/840

[58] Field of Search ..... 272/69; 198/840, 861.5; 474/140, 101, 111

[56] References Cited

U.S. PATENT DOCUMENTS

| | | | |
|---|---|---|---|
| 2,239,687 | 4/1941 | Parker | 198/840 X |
| 2,380,221 | 7/1945 | Cundall | 474/140 |
| 2,434,760 | 1/1948 | Eggleston | 198/861.5 |
| 3,731,917 | 5/1973 | Townsend | 272/69 |
| 4,629,062 | 12/1986 | Silverthorn et al. | 198/840 |

*Primary Examiner*—Richard J. Apley
*Assistant Examiner*—Howard Flaxman
*Attorney, Agent, or Firm*—Polster, Polster and Lucchesi

[57] ABSTRACT

An exercise treadmill for forward and/or rearward walking. The treadmill has a frame with spaced side rails and spaced uprights extending upwardly from the front end of the side rails. Spaced front and rear rollers extend transversely between the side rails. An endless belt entrained about the rollers has an upper reach on which a user runs or walks. To maintain the belt in a predetermined path around the rollers, a guide is provided which imparts a resilient deflecting force on the lower reach to deflect the belt, adjacent its opposite marginal edge portions, prior to movement of the belt across a roller, as it moves from the lower to the upper reach of the treadmill. Where both forward and backward walking are desired endless belt guides are provided on the lower reach of the belt adjacent each roller to maintain the belt in the predetermined path, regardless of direction of movement. An adjustable elevating system includes idler pulleys mounted on uprights and a bedframe over which a cable is entrained. Opposite ends of the cable are attached to the side rails and bedframe adjacent the uprights. A reversible rotatable shaft, through which the cable is threaded, changes the amount of cable available to cause the bedframe to be raised or lowered.

9 Claims, 3 Drawing Sheets

EXERCISE TREADMILL

BACKGROUND OF THE INVENTION

This invention relates to exercise treadmills, and more particularly to an exercise treadmill which permits both forward backward walking, and further provides an adjustable elevating system for the treadmill.

Exercise treadmills are used for both medical testing purposes as well as for indoor exercise. In medical testing facilities, exercise treadmills permit patients undergoing stress electrocardiogram or other medical tests to exercise vigorously while medical data is collected. Indoor exercise, the other principal area of use, includes not only the commercial market where exercise treadmills have been used in health clubs, spas, and gyms, for example, but also in homes or offices use where exercise-conscious individuals prefer the simulated experience of a controlled walking or running program indoors in a minimum amount of space. Exercise treadmills used in medical testing or commercial exercise facilities are often quite substantial, due to the repeated use of such equipment. As a result, the cost of such exercise treadmills is beyond the financial capabilities of many potential users in the home or office market. In order to broaden the market to the home or office use, as well as remain competitive, the cost of the treadmill is exceedingly important.

Whatever the intended end use, both the construction and operation of exercise treadmills are well known. Typically, an exercise treadmill includes an endless belt entrained about a pair of frame mounted spaced rollers, with one of the rollers being driven at a pre-selected speed. The user must run or walk on the moving endless belt in order to maintain a predetermined position on the treadmill. Treadmills enable users to not only change the speed, but also the inclination of the endless belt to vary the amount of exercise required.

In the typical operation, the endless belt is driven from the front to the rear of the treadmill, and this requires the user to walk forward to expend the necessary energy to keep pace with the endless belt speed. For those treadmills permitting reverse operation, the endless belt would be driven from the rear to the front, and thus a user must be able to walk backwards at a predetermined pace coordinated with the speed of the endless belt. By walking backwards, treadmill users are able to utilize a different set of muscles in the legs, and shock on the knees is reduced. Many therapists recommend walking backwards for strengthening legs and leg muscles.

However, building and successfully operating a reversing treadmill is not simply a matter of rewiring the motor for reverse operation. It will be appreciated that when the belt of the treadmill is operated in the normal or front to rear direction, the top run or reach of the endless belt moves from the front to the rear, while the bottom run or reach of the belt moves from the rear to the front. Since the lower reach or run of the driven endless belt is in tension, a belt guide must be employed on the lower reach of the belt adjacent the front roller of the treadmill so as to precisely guide the belt in tension as it is entrained around the front or normally driven roller. In reverse operation of the treadmill, the belt guide adjacent the front roller is relatively useless because the endless belt has little or no tension as it moves around the front roller. Thus, a rear belt guide must be used adjacent the rear roller to guide the belt in tension as it moves from the rear roller to the upper reach of the exercise treadmill.

In prior art treadmills, it was conventional to use additional idler rollers as belt guides. However, these belt guide idler rollers are expensive, requiring additional rollers and bearings in the treadmill. Other treadmills have utilized crown rollers, that is, having a larger diameter in the center than at the edges of the rollers, in order to guide the endless belt. U.S. Pat. No. 4,344,616 shows the use of crown rollers for an endless belt in an exercise treadmill. Another approach shown in U.S. Pat. No. 3,731,917 utilizes opposed sheet metal belt guides for guiding the endless belt around the rollers. None of these constructions have been effectively employed in an exercise treadmill where both forward and rearward direction is desired. Thus, substantial problems exist in building and sucessfully operating an exercise treadmill which provides both forward and rearward walking, where an effective and economic solution for endless belt guides must be incorporated in the construction of the treadmill.

In addition to increasing the speed or changing the direction of the endless belt to vary the type and amount of physical exercise by the user of the treadmill, it is often times typical for the treadmill to have an elevation system which selectively raises the front of the treadmill relative to the rear of the treadmill. By inclining the jogging or walking surface, the user will be required to walk or run uphill, thus expending additional energy.

Treadmill elevation systems have included a variety of designs. Thus, single or multiple screw jacks such as shown in U.S. Pat. Nos. 3,643,943 and 4,344,616 have been employed; interchangeable legs of different lengths have been used in U.S. Pat. No. 3,731,917; and fluid cylinders for inclination of the treadmill frame are shown in U.S. Pat. No. 3,826,491; and rack and pinion drives for elevating a treadmill or the like are shown in U.S. Pat. Nos. 1,870,244 and 3,022,433 and in my U.S. patent application Ser. No. 057,043 filed Jun. 3, 1987.

While the above described constructions are general examples of what has been employed in the past, they have not met all of the required demands of today's market. Treadmill elevation systems must meet the joint demands of not only providing a stable and powerful elevating system, but they must do so without substantial costs involved.

SUMMARY OF THE INVENTION

Among the several objects and features of the invention may be noted:

The provision of an exercise treadmill having an improved guide system along the lower run or reach of the endless belt;

The provision of such a treadmill in which the improved guide system imparts opposing resilient and adjustable deflecting forces on the endless belt to maintain it in a predetermined path around the front roller of the treadmill;

The provision of such a treadmill in which both forward and/or backward walking is permitted, through the employment of opposing resilient deflecting forces on the endless belt adjacent both the front and rear rollers as the endless belt moves from the lower reach or run to the upper reach or run of the endless belt;

The provision of such an exercise treadmill in which the improved endless belt guide system utilizes a minimum number of parts, is simple and easy to fabricate, is economical, is easy to install and maintain, has little or no maintenance, is highly efficient, and is otherwise well adapted for the purposes intended;

The provision of such an exercise treadmill which provides a positive, stable and adjustable elevation system for both elevating and lowering the endless belt of the exercise treadmill;

The provision of such an exercise treadmill employing an adjustable elevation system which simultaneously lifts or lowers the endless belt on opposite sides in equal amounts for precise control and adjustment;

The provision of such a treadmill elevation system which is of extremely low cost in comparison with other comparable systems performing in the same manner, and The provision of such a treadmill elevational system which is of simple and rugged construction, which is easy o install and maintain, which has a long service life, and which is easy to use.

Other objects and features of this invention will become apparent in the description of the invention that is to follow.

Briefly stated, the exercise treadmill of the present invention includes an elongated frame having a pair of spaced side rails or members which extend generally lenghthwise of the treadmill. A pair of generally parallel and spaced rollers are journalled on and extend transversely between the side members. An endless belt is entrained around the rollers and provides an upper reach on which the user of the treadmill runs or walks, and a lower reach. At least one of the rollers drives the endless belt in a predetermined endless path around the rollers. Belt guide means are provided for maintaining the endless belt in the predetermined endless path as it moves around the rollers. The guide means imparts a resilient deflecting force on the lower reach to deflect the endless belt adjacent opposite marginal edge portions of the endless belt in the vicinity of at least one roller prior to the movement of the endless belt from the lower reach to the upper reach, in order to confine the endless belt in the predetermined endless path as it moves around the rollers. For both forward and reverse direction of the endless belt for forward or backwards walking, the belt guide means are provided in the vicinity of both the rollers prior to the movement of the endless belt across the rollers in traveling from the lower reach to the upper reach, to thereby confine the endless belt in the predetermined endless path, regardless of direction of the endless belt.

The adjustable elevating system for the exercise treadmill includes idler pulleys which are mounted on uprights at the front of the exercise treadmill and along a front rail extending between the side rails or members of the frame. A single cable is entrained over the pulleys, and opposite ends of the cables are attached to the side rails and interconnected bedframe adjacent the spaced uprights. In order to reduce and increase the amount of cable available throughout the adjustably elevating system, a rotatable shaft is provided to permit winding and unwinding of the cable therearound to cause the bedframe to be raised or lowered in response to the reduction or increase of cable throughout the system.

BRIEF DESCRIPTION OF THE DRAWINGS

Corresponding reference characters indicate corresponding parts throughout the several views of the drawings.

DESCRIPTION OF A PREFERRED EMBODIMENT

Figure 8:
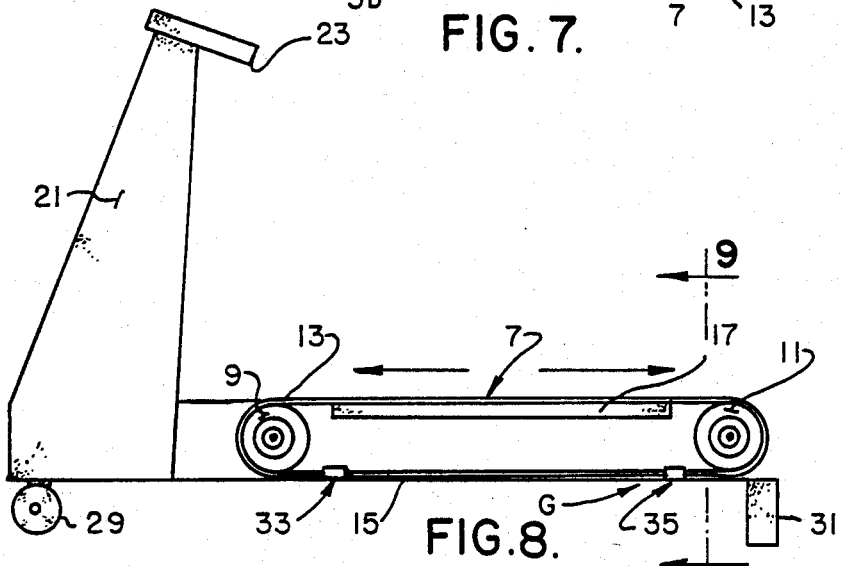
FIG. 8 is a left side elevational view of the treadmill, showing both forward and reverse direction for forward and backward walking on the treadmill.

Referring now to the drawings, an exercise treadmill is indicated in its entirety by reference character 1. The treadmill 1 is shown to comprise a frame, as generally indicated at 3, having a pair of generally horizontally disposed, spaced apart side rails or members **5*a*, 5*b* which extend generally lengthwise of the treadmill 1. An endless belt, as generally indicated at 7, is entrained about a front and rear roller 9, 11 respectively, as best seen in FIG. 8 of the drawings. The front and rear rollers 9, 11 are interposed between and journalled on the side members 5*a*, 5*b* so as to extend transversely therebetween. The endless belt 7 includes an upper reach or run 13 on which a user walks or runs, and a lower reach 15. The upper reach or run 13 of the endless belt 7 is supported by an underlying panel or bed 17 to provide support for the upper reach or run 13 of the endless belt 7 to enable a user of the treadmill to be supported by the underlying panel 17 as the user walks or jogs on the upper reach or run 13 of the treadmill 1**.

The frame 3 of the treadmill further includes a pair of spaced treadmill uprights covers or legs 19, 21 extending generally upwardly from respective side rails **5*a*, 5*b* at the forward or front end of the frame 3. At the upper end of the treadmill uprights covers or legs 19, 21, a control panel 23 extends transversely therebetween. At the lower end of the treadmill legs 19, 21, a front rail or frame member 25 spans the distance between the side rails 5*a*, 5*b*. A cover 27 extends between the legs 19, 21 and encloses the front roller and drive mechanism for the treadmill endless belt. Supporting wheels 29** are provided at the front of the exercise treadmill for movement and/or repositioning of the treadmill.

As thus far described, treadmill 1 is substantially conventional. Certain portions of the treadmill 1 shown schematically are generally described, as they form no part per se of the present invention. Various constructions may, therefore, be employed in these areas which do not constitute the invention. For example, the slider bed over which the endless belt moves may be constructed along the lines of our prior U.S. Pat. No. 4,616,822 issued on Oct. 14, 1986. Other constructions and designs may be employed in other areas of the treadmill, as may be desired.

Thus, it will be understood that the present invention is directed to the endless belt guide system G to permit forward and/or rearward operation of the endless belt for forward and backward walking, as well as to an adjustable elevation system for the endless belt.

The endless belt guide system of the present invention is best seen in FIG. 7–11 of the drawings. The endless belt guide system G is designed to maintain the endless belt 7 in a predetermined endless path as it moves around the front and rear rollers 9, 11, respectively. When the endless belt 7 is operated in the normal direction, that is, the top reach of the belt moves from front to rear, as shown by the arrow in FIG. 7 of the drawings. In this instance, i.e., front operation, a front belt guide 33 must be employed on the lower reach of 15 of the endless belt 7 adjacent the forward end of the treadmill 1 so as to precisely guide the endless belt in tension as it is entrained about the front or driven roller 9. In reverse operation, that is, where the upper reach 13 of endless belt 7 moves from the rear to the front of the treadmill, endless belt 7 has little or no tension in it after it moves around the front roller 9. Thus, front endless guide means 33 must be provided when the endless belt is driven in the normal operation from front to rear, and a rear endless belt guide means 35 must be provided when the endless belt is driven in reverse operation.

In accordance with an important feature of the present invention and as best seen in FIGS. 8–11 of the drawings, the present invention includes the above-noted front and rear endless belt guide means 33, 35 which are constructed in a manner to be described for cooperation with lower reach 15 and the front and rear rollers 9, 11 respectively. Since each of the front and rear belt guide means 33, 35 is constructed in the same manner, it will only be necessary to describe the construction and operation of one of such belt guide means for an understanding of the other.

Figure 9:
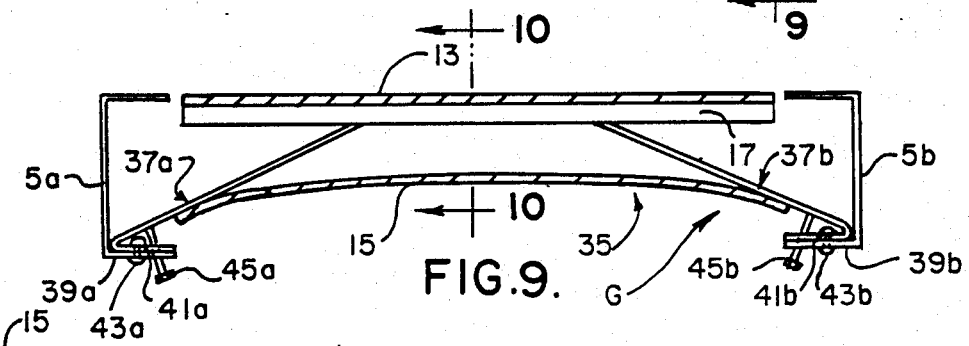
FIG. 9 is a fragmentary sectional view on an enlarged scale taken along line 9—9 of FIG. 8 illustrating the construction of the endless belt guide means in association with the endless belt of the present invention.
Figure 10:
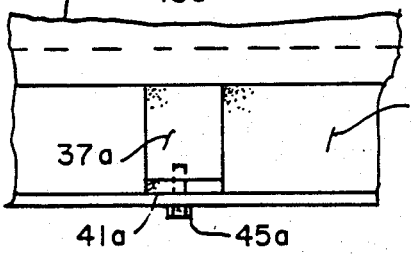
FIG. 10 is a fragmentary elevational view taken along line 10—10 of FIG. 9 showing the inside of one of the side rails in the vicinity of the location of the endless belt guide means of the present invention.
Figure 11:
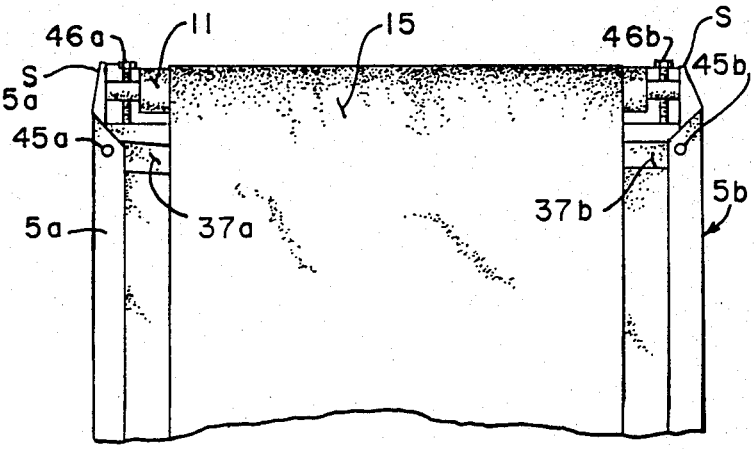
FIG. 11 is a fragmentary bottom plan view along the rear or righthand end of the exercise treadmill, as shown in FIG. 8, in the vicinity of the opposed endless belt guide means of the present invention.

Therefore, attention is directed to FIGS. 9–11 of the drawings for a description of the rear endless belt guide means 35 of the present invention. The rear endless belt guide means 35 comprises a pair of opposed elongated flexible elements **37*a*, 37*b* which are attached at their lower end to the inwardly and transversely directed flanges 39*a*, 39*b* extending from the lower end of the side members 5*a*, 5*b*. Each of the elongated flexible elements 37*a*, 37*b* has angularly offset foot sections 41*a*, 41*b* respectively, which extend in substantially parallel relationship to the transverse flanges 39*a*, 39*b* and which secured thereto by a respective rivet 43*a*, 43*b*, or the like. From the angularly offset foot sections 41*a*, 41*b*, the elongate flexible elements 37*a*, 37*b* extend upwardly and inwardly therefrom for engagement with the under surface of the bed 17, as shown in FIG. 9. As a result of the engagement of the elongated flexible elements 37*a*, 37*b* with the underside of the bed 17, the area between the fixed and supported ends of the elongate flexible elements 37*a*, 37*b* are capable of predetermined limited flexible movement. Adjusting screws 45*a*, 45*b* are threadably mounted through the transverse flanges 43*a*, 43*b*, of side rails 5*a*, 5*b* respectively for engaging the elongate flexible elements 37*a*, 37*b* thereby to adjust the amount of resilient deflecting force between the fixed ends and their ends in engagement with the underside of bed 17. Adjusting screws 46*a*, 46*b* extend through shaft supports S, as shown in FIG. 11, on which the rear roller 11 is mounted and bear against the treadmill frame or bed support for adjusting the amount of tension in the endless belt 7**.

Thus, the area of the elongated flexible elements **37*a*, 37*b* intermediate the fixed and supported ends thereof is capable of applying or imparting a resilient deflecting force on the outer margins of the lower reach 15 of the endless belt 7 so as to at least in part deflect the endless belt, as shown in FIG. 9 of the drawings. Specifically, the elongate flexible elements 37*a*, 37*b* deflect the endless belt 7 adjacent opposite marginal edge portions of the endless belt in the vicinity of the rear roller 11, prior to the movement of the endless belt from the lower reach to the upper reach, during reverse operation of the endless belt 7. The resilient deflecting force imparted through the elongate flexible elements 37*a*, 37*b* causes the outer margins of the endless belt 7 of the lower reach 15 thereof to be deformed downwardly, in order to confine the endless belt 7 in the predetermined endless path along the lower reach 15 as it moves around the rear roller 11, during reverse operation. In this manner, the elongate members 37*a*, 37*b* of front and rear guide means 33, 35 exert a centering force on the lower reach of the belt immediately adjacent their respective front and rear rollers 9, 11. It will be noted that the edge or marginal portions of the endless belt 7 are not contacted by the elongate flexible elements 37*a*, 37*b*, but rather engage an upper or inside surface of the lower reach 15 adjacent to the marginal edge portions of the endless belt 7, as best shown in FIG. 9 of the drawings. In this manner, wear on the belt caused by the flexible elements 37*a*, 37*b*** is minimized.

The position of the generally opposed elongate flexible elements **37*a*, 37*b* relative to the rear roller 11 is important. Thus, as shown in FIGS. 8 and 11 of the drawings, the elongated flexible elements 37*a*, 37*b* are positioned just prior to the rear roller 11 to enable the lower reach of the belt 15, as it moves in tension about the rear roller 11 during reverse operation, to be constrained and centered in its desired predetermined endless path, as a result of the generally opposing resilient deflecting forces imparted to the lower reach 15, by way of the elongated flexible elements 37*a*, 37*b* on opposite sides of the belt. Similarly, in forward operation, the flexible elements 37*a*, 37*b* of the forward belt guide means 33, as shown in FIG. 8 of the drawings, are positioned just prior to the front roller 9, to enable the elongated flexible elements 37*a*, 37*b*, to engage the lower reach 15 of the endless belts 7 as it moves in tension around the front roller 9 from the lower reach 15 to the upper reach 13 of the endless belt 7. In this way, the endless belt 7 is constrained and confined to operate in the desired predetermined endless path, regardless of direction of operation of the endless belt 7**.

Figure 5:
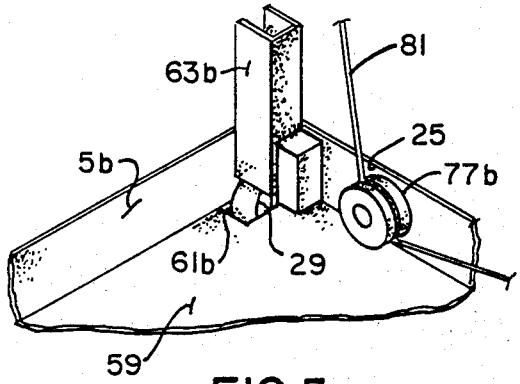
FIG. 5 is a fragmentary perspective view illustrating a portion of the adjustable elevation system of the present invention.
Figure 6:
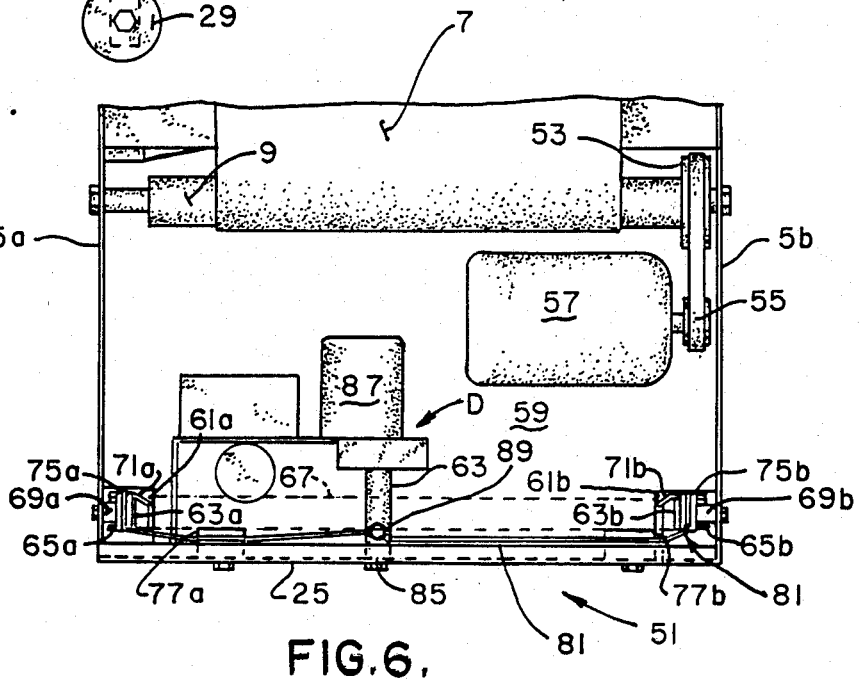
FIG. 6 is a fragmentary top elevational view illustrating the adjustable elevation system of the present invention.
Figure 7:
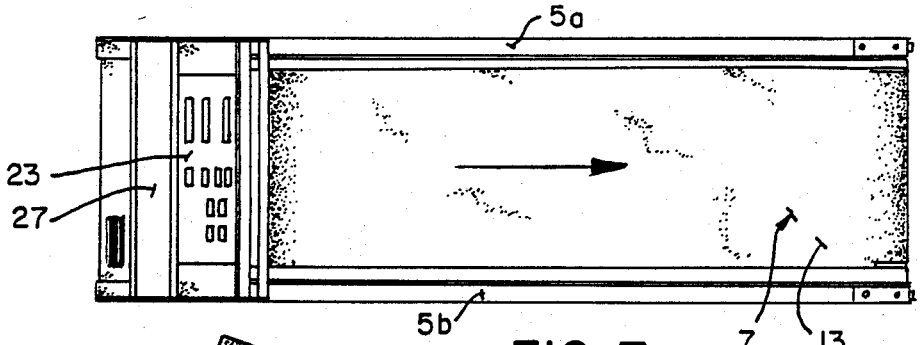
FIG. 7 is a top elevational view of the exercise treadmill showing the endless belt moving from front to rear during normal operation of the treadmill.

As a further important feature of the present invention, a simple, but very effective adjustable elevating system, as generally indicated at 51, will be described in connection with FIGS. 2–6 of the drawings. In FIG. 6 of the drawings, the endless belt 7 is shown as being entrained around the front roller 9, and having a pulley 53 at one end over which a drive belt 55 is provided to transmit power from a reversible motor 57. The motor 57 is positioned on a bedframe 59 and mounted in advance of the front roller 9 of the treadmill 1. The bedframe 59 is attached and secured to the lower ends of the side members 5*a*, 5*b*, as well as to the lower end of the front rail or frame 25. The bedframe 59 is provided with openings 61*a*, 61*b* adjacent the juncture of the side members at 5*a*, 5*b* and the front rail 25, for receiving spaced uprights 63*a*, 63*b* which extend upwardly from the bedframe 59 to an upper end thereof, as indicated at 65*a*, 65*b*, respectively. The uprights 63*a*, 63*b* are connected to one another below the bedframe 59 by a transverse strut 67. Each of the uprights 63*a*, 63*b* is channel-shaped in cross section (as best shown in FIG. 5) with the channel opening thereof positioned adjacent the side members 5*a*, 5*b* in order to permit an idler roller 69*a*, 69*b* (see FIG. 6) attached to each of the side members 5*a*, 5*b* to be received within the channel opening of the channel-shaped upright 63*a*, 63*b*. The idler rollers 69*a*, 69*b* move in the channel openings of the uprights 63*a*, 63*b* permits the uprights 63*a*, 63*b* within legs 19, 21 to be maintained in the same general orientation as the bedframe 59 is moved in various angular positions relative thereto. As can be appreciated, the bedframe 59, together with the side members 5*a*, 5*b* and the front rail 25, move together as a unit, as a result of the opening 61*a*, 61*b* in the bedframe 59, which allows the movement of these components relative to the spaced uprights 63*a*, 63*b* thereby to effect changes in elevation of the treadmill, as shown in FIG. 2.

Figure 1:
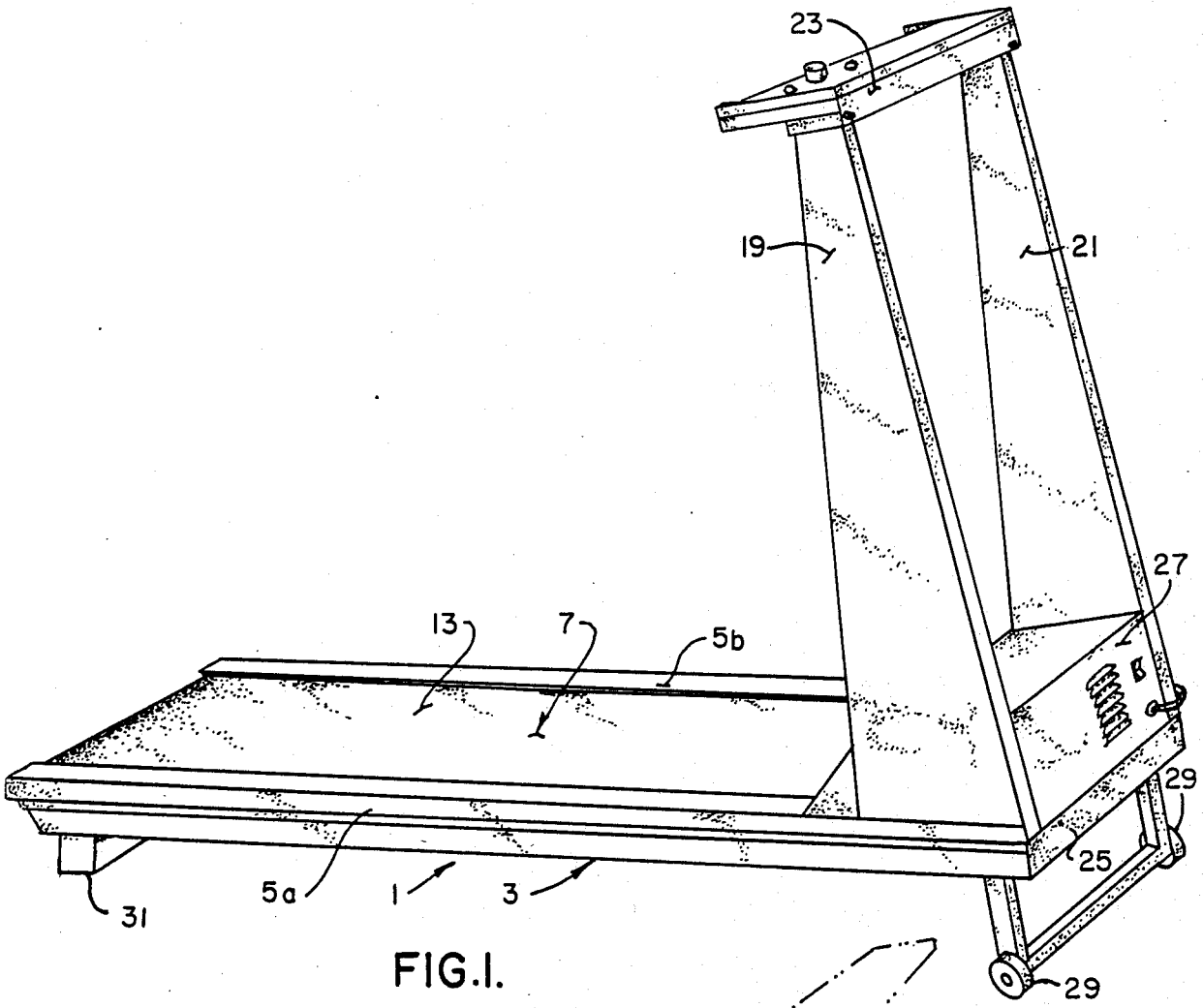
FIG. 1 is a front perspective view of an exercise treadmill incorporating an endless belt guide means and adjustable elevating system of the present invention.
Figure 2:
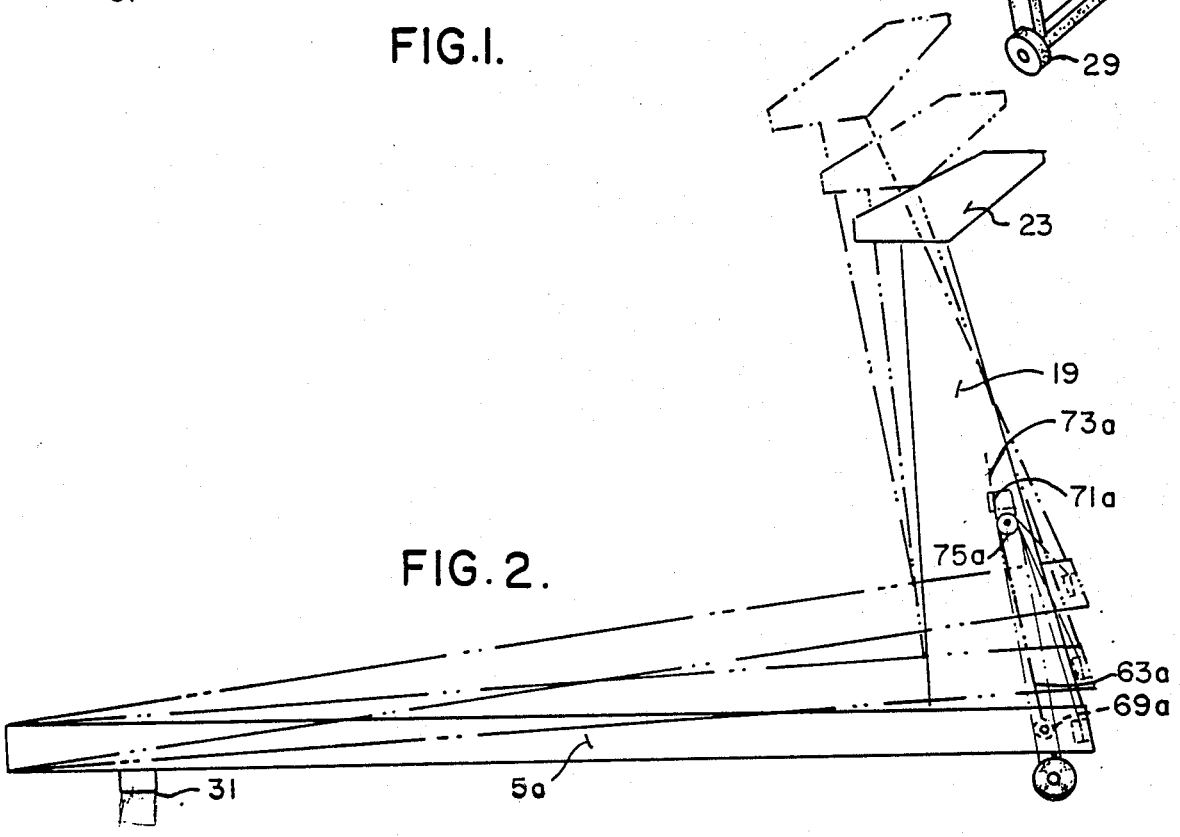
FIG. 2 is a right side elevational view of the treadmill showing a series of elevated positions for the treadmill, in which it is raised from a lower solid line position to upper dotted or phantom line positions.
Figure 3:
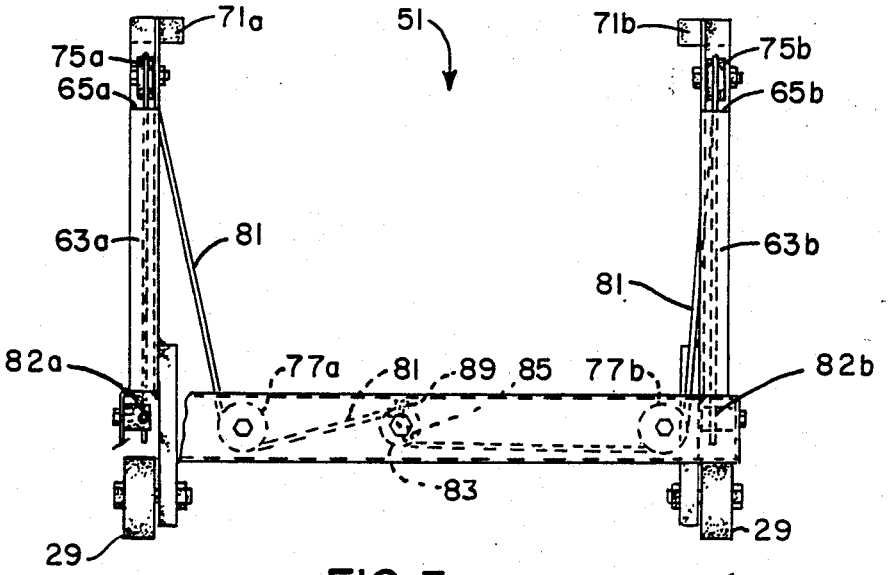
FIG. 3 is a front end elevational view illustrating the adjustable elevation system of the present invention.
Figure 4:
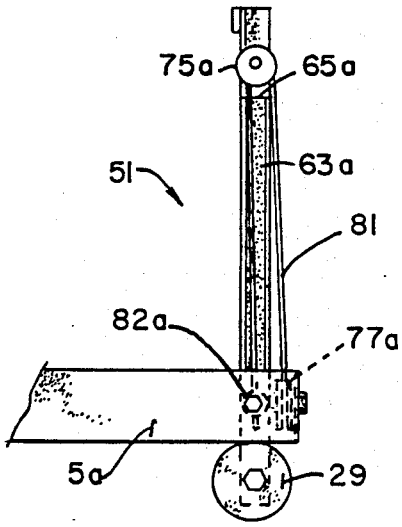
FIG. 4 is a fragmentary side elevational view illustrating the adjustable elevation system of the present invention.

As also shown in FIGS. 2 and 6 of the drawings, each of the uprights 63*a*, 63*b* is provided with a flexible track guide 71*a*, 71*b* mounted adjacent the upper ends 65*a*, 65*b* of the spaced uprights 63*a*, 63*b*, respectively. The flexible track guides 71*a*, 71*b* are constructed to move within a generally vertically directed track section provided in the treadmill legs 19, 21. As shown in FIG. 2 of the drawings, a vertically directed track section 73*a* is provided in the treadmill leg 19 in order to allow the flexible track guide 71*a* to be received and moved therein, as the idler roller 69*a* is moved within the channel opening of the channel-shaped upright 63*a*. With this construction, the bedframe 59, together with its associated side rails 5*a*, 5*b* and front rail 25, are able to move in angular positions relative to the horizontal floor surface, while allowing the spaced upright 63*a* and treadmill leg 19 to be maintained in the same position relative to one another. Of course, a similar track section 73*a* is provided in leg 21 for engagement by a similar track guide 71*b* carried on the upper end of upright 63*b*.

The adjustable elevating system includes idler pulleys 75*a*, 75*b* mounted on the respective uprights adjacent the upper ends 65*a*, 65*b* thereof. Furthermore, a second pair idler pulleys 77*a*, 77*b* is mounted on the front rail 25, adjacent the spaced uprights 63*a*, 63*b*. A single cable 81 is entrained about all of the aforementioned idler pulleys, with opposite ends of the single cable 81 being attached to the side members 5*a*, 5*b* adjacent the spaced uprights 63*a*, 63*b*, as indicated at 82*a*, 82*b*, respectively. Specifically, it will be seen that from the side member 5*a*, the single cable 81 extends upwardly along the upright 63*a* and is entrained about the idler pulley 75*a* at the upper end of the upright 63*a* and then proceeds downwardly along the upright 63*a* and is entrained about the idler pulley 77*a*. From there, the cable 81 extends generally horizontally along the front rail 25 between the spaced idler pulleys 77*a*, 77*b*, and then extends upwardly along the spaced upright 63*b* until it is entrained about the idler pulley 75*b* and connected to the side member 5*b*, adjacent the upright 63*b*.

In order to reduce and increase the amount of cable 81 available throughout the system, and to cause the bedframe 59 to be raised or lowered in response to the reduction or increase of the cable 81, a drive means D including a rotatable shaft 83 is provided. The rotatable shaft 83 is rotatably supported on the bedframe 59 midway between uprights 63*a*, 63*b* and includes an opening 85 therethrough through which the cable 81 extends. At the inner end of the rotatable shaft 83, a reversible gear motor 87 is provided. In operating the gear motor 87 in one direction, the cable 81 on opposite sides of the rotatable shaft 83 will be drawn in and wound up on the shaft or played out in equal amounts, to cause raising or lowering of the bedframe 59. For elevating the bedframe 59 relative to the spaced uprights 63*a*, 63*b*, the cable 81 must be wound about the rotatable shaft 83 to simultaneously draw in the cable 81, on opposite sides of the rotatable shaft 83, throughout the entire system. This forces uprights 63*a*, 63*b* downwardly with respect to the front of bedframe 59 and thus lifts the front of the treadmill, as shown in phantom lines in FIG. 2. Reverse operation of the motor 87 causes more cable 81 to be unwound from shaft 83 and to thus be made available throughout the system, which thereby results in lowering the bedframe 59 and associated components relative to uprights 63*a*, 63*b*. It will be noted in FIG. 6 of the drawings that the rotatable shaft includes a pin or set screw 89 which attaches and fixes the cable 81 to the rotatable shaft 83 in order to prevent any sliding or slipping thereof during winding and unwinding of the cable 81.

It will also be noted that the floor supports 31 at the rear of the treadmill 1 may have a height greater than the supporting wheels 29 at the front of the treadmill 1, to provide a predetermined initial downward inclination of forward end of the endless belt 7.

In FIG. 5 of the drawings, it will be seen that the supporting wheel 29 attached to the lower end of the upright 63*b* extends upwardly at least partially within the opening 61*b* formed in the bedframe 59. This enables the supporting wheel 29 to be positioned in closely spaced position relative to the side rail 5*b*. Also, the outer surface adjacent to the channel opening of the upright 63*b* is preferably in substantial alignment with the outermost extent of the floor roller 29, in order to be received by the side rail 5*b* in closely spaced relationship thereto. This construction affords a precise and controlled fit of the upright 63*b*, relative to the bedframe 59*b*, side rail 5*b* and front rail 25. The same advantages would be afforded to the upright 63*a* on the opposite side of the frame at the front of the treadmill 1.

In operation of the elevational system, when the rotatable shaft 83 is rotated to wind the cable 81 thereabout, a shorter amount of cable 81 will be made available throughout the system, and this causes simultaneous lifting of the bedframe 59, through the attachment of the opposite ends of the cable 81 to the side members 5*a*, 5*b*. A control switch (not shown) mounted on the control panel 23 provides precise positionment and location of the bedframe 59. And the endless belt 7 interconnected therewith through the side members 5*a*, 5*b*. Another switch (not shown) on the control panel 23 may be depressed to unwind the cable 81 from the rotatable shaft 83, thus causing the cable 81 to be played out, reversing the inclination of the treadmill. As a result of the cable 81 passing through the opening 85 in the rotatable shaft 83, it will require the cable 81 on opposite sides of the rotatable shaft 83 to impart simultaneous and equal movement in raising and lowering the treadmill, thereby providing a stable, positive and adjustable elevating system. It will be appreciated that energization of gear motor 87 may be stopped at any desired elevation of the treadmill within its elevational range and the gearmotor 87 cannot be back driven. In this manner, the gearmotor serves to lock the treadmill in any desired elevational position and is thus infinitely variable.

In view of the above, it will be seen that the other objects of this invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

What is claimed:

1. An exercise treadmill comprising a frame having a pair of spaced side members extending generally lengthwise of said treadmill, a pair of generally parallel, spaced rollers journalled on and extending transversely between said side members, an endless belt entrained around said rollers and providing an upper reach on which a user of said treadmill runs or walks and a lower reach, means for driving one of said rollers to drive said endless belt in a predetermined endless path around said rollers, belt support means carried by said frame for supporting the upper reach of said belt, and resilient belt guide means engaging said belt support mean for maintaining said endless belt in said predetermined endless path as it moves around said rollers, said belt guide means imparting a deflecting force on the lower reach of said belt for, at least in part, deflecting said endless belt adjacent opposite marginal edge portions thereof in the vicinity of at least one roller prior to the movement of said endless belt from the lower reach to the upper reach thereby to confine said endless belt in said predetermined endless path as it moves around said rollers.

2. The exercise treadmill as defined in claim 1 wherein said means imparting a resilient deflecting force to said lower reach of said belt comprises a pair of elongate flexible elements which are mounted to respective said spaced side members in opposed relationship to one another, said elongate flexible elements being angularly offset relative to the lower reach of said endless belt for engaging and deflecting said endless belt adjacent opposite marginal edge portions thereof so as to confine said endless belt in said predetermined endless path.

3. The exercise treadmill as defined in claim 2 wherein said spaced side members at a lower end below the endless belt are each provided with a respective transverse flange which extends inwardly of said side members, each said elongate flexible element being attached at one end to a said transverse flanges and being angularly directed upwardly therefrom to engage the lower reach of said endless belt on the upper surface thereof adjacent opposite marginal edge portions of said endless belt.

4. The exercise treadmill as defined in claim 3 wherein the free ends of said elongate flexible elements engage the bed support means on the underside thereof, and each of the elongate flexible elements intermediate the fixed and supported ends thereof being capable of predetermined limited deflection thereof.

5. The exercise treadmill as defined in claim 4 including means for adjusting the amount of deflecting force provided by said elongated flexible elements, said adjusting means comprising an adjusting screw threadably mounted to each transverse flange for engaging a respective elongate flexible element to adjust the amount of resilient deflecting force applied to said endless belt.

6. An exercise treadmill to permit both forward and backward walking, said treadmill comprising a frame having a pair of spaced side members extending generally lengthwise of said treadmill, a pair of generally parallel, spaced rollers journalled on and extending transversely between said side members, an endless belt entrained around said rollers and providing an upper reach on which the user of the treadmill walks both forward and backward and a lower reach, means for driving one of said rollers to drive said endless belt in either rotational direction in a predetermined endless path around said rollers thereby to permit either forward or backward walking on said treadmill, belt support means carried by said frame for supporting the upper reach of the endless belt, and resilient belt guide engaging said belt support means means for maintaining said endless belt in said predetermined endless path regardless of the direction of movement of said endless belt, said belt guide means imparting a deflecting force on said lower reach so as to at least partially deflect the opposite marginal edge portions of said endless belt adjacent one of said rollers prior to the movement of said endless belt from said lower reach to said upper reach, for confining the endless belt in said predetermined endless path as it moves from said lower reach to said upper reach about said at least one roller.

7. The exercise treadmill as defined in claim 6 including means for elevating the front of said treadmill relative to the back thereof to provide both forward direction and inclination as well as reverse direction and inclination of said endless belt.

8. An exercise teadmill comprising a frame having a pair of spaced side members extending generally lengthwise of said treadmill, a pair of generally parallel, spaced rollers journalled on and extending transversely between said side members, an endless belt entrained around said rollers and providing an upper reach on which a user of said treadmill runs or walks and a lower reach, means for driving one of said rollers to drive said endless belt in a predetermined endless path around said rollers, belt support means carried by said frame for supoorting the upper reach of said belt, and resilient belt guide means contacting said belt support mean for maintaining said endless belt in said predetermined endless path as it moves around said rollers, said belt guide means imparting a resilient deflecting force on the lower reach of said belt for, at least in part, deflecting said endless belt adjacent opposite marginal edge portions thereof in the vicinity of at least one roller prior to the movement of said endless belt from the lower reach to the upper thereby to confine said endless belt in said predetermined endless path as it moves aroundsaid rollers, belt guide means imparting comprising a pair of elongate flexible elements mounted to respective said spaced side members in opposed relationship to one another, said elongate flexible elements being angularly offset relative to the lower reach of said endless belt for engaging and deflecting said endless belt adjacent opposite marginal edge portions thereof so as to confine said endless belt in said predetermined endless path, said spaced side members at a lower end below the endless belt being each provided with a respective transverse flange extending inwardly of said side members with each said elongate flexible element being attached at one end to a said transverse flanges and being angularly directed upwardly therefrom to engage the lower reach of said endless belt on the upper surface thereof adjacent opposite marginal edge portions of said endless belt, the free ends of said elongate flexible elements engaging the bed support means on the underside therof, and each of the elongate flexible elements intermediate the fixed and supported ends thereof being capable of predetermined limited deflection thereof.

9. The exercise treadmill as defined in claim 8 including means for adjusting the amount of deflecting force provided by said elongated flexible elements, said adjusting means comprising an adjusting screw threadably mounted to each transverse flange for engaging a respective elongate flexible element to adjust the amount of resilient deflecting force applied to said endless belt.

* * * * *